US010111546B1

(12) United States Patent
Springs et al.

(10) Patent No.: US 10,111,546 B1
(45) Date of Patent: Oct. 30, 2018

(54) ORGANIZER WITH SUSPENDED STAPLER HOLDER

(71) Applicant: HSN, Inc., St. Petersburg, FL (US)

(72) Inventors: Keith Alan Springs, Brecksville, OH (US); Peter Dean Rimback, South Euclid, OH (US)

(73) Assignee: HSN, INC., St. Petersburg, FL (US)

( * ) Notice: Subject to any disclaimer, the term of this patent is extended or adjusted under 35 U.S.C. 154(b) by 0 days.

(21) Appl. No.: 15/814,799

(22) Filed: Nov. 16, 2017

(51) Int. Cl.
*A45C 11/00* (2006.01)
*A47G 29/08* (2006.01)
*B25C 7/00* (2006.01)

(52) U.S. Cl.
CPC ..... *A47G 29/08* (2013.01); *B25C 7/00* (2013.01)

(58) Field of Classification Search
CPC ..... A47G 29/08; B25C 7/00; A45C 11/36; F16M 13/00
USPC ..... 206/806, 371; 248/610, 613, 611
See application file for complete search history.

(56) References Cited

U.S. PATENT DOCUMENTS 2,780,260 A * 2/1957 Watson ..... A47G 25/005 383/23
4,176,743 A 12/1979 Fitzpatrick
4,557,456 A * 12/1985 Mueller ..... A45C 11/38 248/220.31
5,097,417 A * 3/1992 Ukon ..... G06F 17/211 715/235
5,141,113 A * 8/1992 Elliott ..... A45C 11/16 206/495
5,413,297 A * 5/1995 Adams ..... A47G 25/0614 248/215
5,427,230 A * 6/1995 Mattox ..... A45C 11/16 206/478
5,533,534 A * 7/1996 Cariello ..... A47K 3/281 132/286
6,109,442 A * 8/2000 Roegner ..... A45C 11/00 150/106
7,189,021 B1 3/2007 Gordon
7,207,088 B2 * 4/2007 Adams ..... A47G 25/0614 16/404
7,866,493 B1 * 1/2011 Hurt ..... A47B 96/16 211/113
8,727,110 B2 * 5/2014 Walsh ..... A45C 11/26 206/6.1

(Continued)

OTHER PUBLICATIONS amazon.com, Wall Control 10-OFC-300 BB Office Wall Mount Desk Storage and Organization Kit, Black, https://smile.amazon.com/Wall-Control-10-OFC-300-BB-Organization/dp/B0002U3CM6/ref=sr_1_18?ie=UTF8&qid=1488812916&sr=8, Mar. 6, 2017, 5 pages.

(Continued)

*Primary Examiner* — Steven A. Reynolds
(74) *Attorney, Agent, or Firm* — Eckert Seamans Cherin & Mellott, LLC; David C. Jenkins

(57) ABSTRACT

An organizer includes a generally planar back member, a hanging assembly, and a retention assembly. The hanging assembly is coupled to said back member and is structured to be further coupled to a vertical support. The retention assembly includes a number of retention elements wherein each retention element structured to maintain an object adjacent to said back member. Further, the number of retention elements includes a suspended stapler holder. The suspended stapler holder is structured to suspend a stapler with minimal contact.

2 Claims, 5 Drawing Sheets

(56) References Cited

U.S. PATENT DOCUMENTS

2002/0071618 A1* 6/2002 Felsenthal ..... A01M 1/2055
383/39

OTHER PUBLICATIONS amazon.com, Ubaymax 3 Compartments PU Leather Office Supplies Organizer Box for Color Pencils, Remote Controls, Mobile Phone, Stapler, Business Card, Cosmetics Holder Storage Box Organizer (Black), https://smile.amazon.com/Compartments-Supplies-Organizer-Controls-Cosmetics/dp/B01HGGJWL8/ref=sr_1_27?ie=UTF8&qid=1488813026&sr=8-27, Mar. 6, 2017, 5 pages.

* cited by examiner

ORGANIZER WITH SUSPENDED STAPLER HOLDER

BACKGROUND OF THE INVENTION

Field of the Invention

The disclosed and claimed concept relates to storage devices and, more particularly, to an organizer including a suspended stapler holder.

Background Information

Organizers are devices structured to support, store, or otherwise contain a number of objects in an organized and easily accessible manner. Organizers are further structured to be temporarily coupled to another support such as, but not limited to, a door. That is, organizers typically included a plurality of hooks sized and shaped to be coupled to the upper end of a door. One embodiment of an organizer included a plurality of substantially identical pockets sized to accommodate shoes. Improvements on such organizers added pockets of different sizes, shelves, and other retention assemblies structured to support, hold, or otherwise maintain and use objects on/in/at the organizer.

Organizers have disadvantages or problems. For example, it is inconvenient to access objects that are used often, such as, but not limited to, a stapler. That is, if a pocket is large, the user must reach into the pocket, or, if the pocket is small, the stapler is likely to fall out when the door is moved. Large pockets and shelves are inconvenient retention elements to store a stapler in that the stapler is substantially enclosed. This may also be expressed by stating that the stapler has an excessive amount of contact with the organizer. Further, organizers have not been constructed so as to be expandable or extendable. That is, there are no organizers that are structured to have additional retention assemblies added thereto. Further, the hooks provided with organizers are not structured to be coupled to doors with a different thickness and without bias. That is, some hooks include a resilient coupling. Such resilient couplings, however, may cause the hooks to scratch or otherwise damage the door. These are problems.

There is, therefore, a need for an improved organizer. There is a further need for an organizer wherein commonly accessed items, such as a stapler, are easily accessed. There is a further need for an organizer that is structured to be expanded, extended, or have additional retention elements added thereto. There is a further need for an organizer wherein a hanging assembly is structured so as to be adjustable but not damage the supporting object.

SUMMARY OF THE INVENTION

These needs, and others, are met by at least one embodiment of the disclosed and claimed concept which provides an organizer that includes a generally planar back member, a hanging assembly, and a retention assembly. The hanging assembly is coupled to said back member and is structured to be further coupled to a vertical support. The retention assembly includes a number of retention elements wherein each retention element is structured to maintain an object adjacent to said back member. Further, the number of retention elements includes a suspended stapler holder. The suspended stapler holder is structured to suspend a stapler with minimal contact.

An organizer in the configuration, and as described below, solves the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
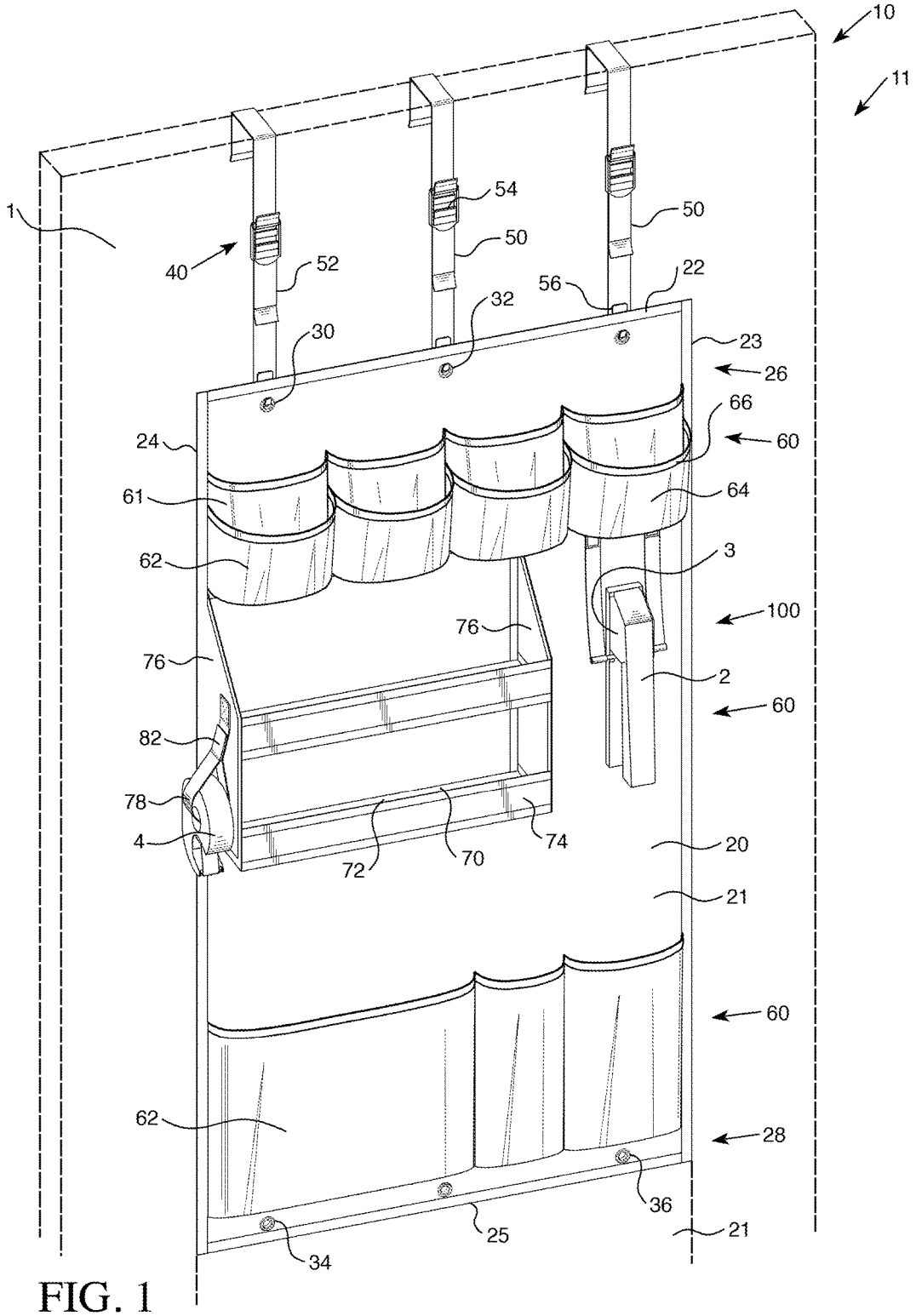
FIG. 1 is an isometric view of an organizer.
Figure 2:
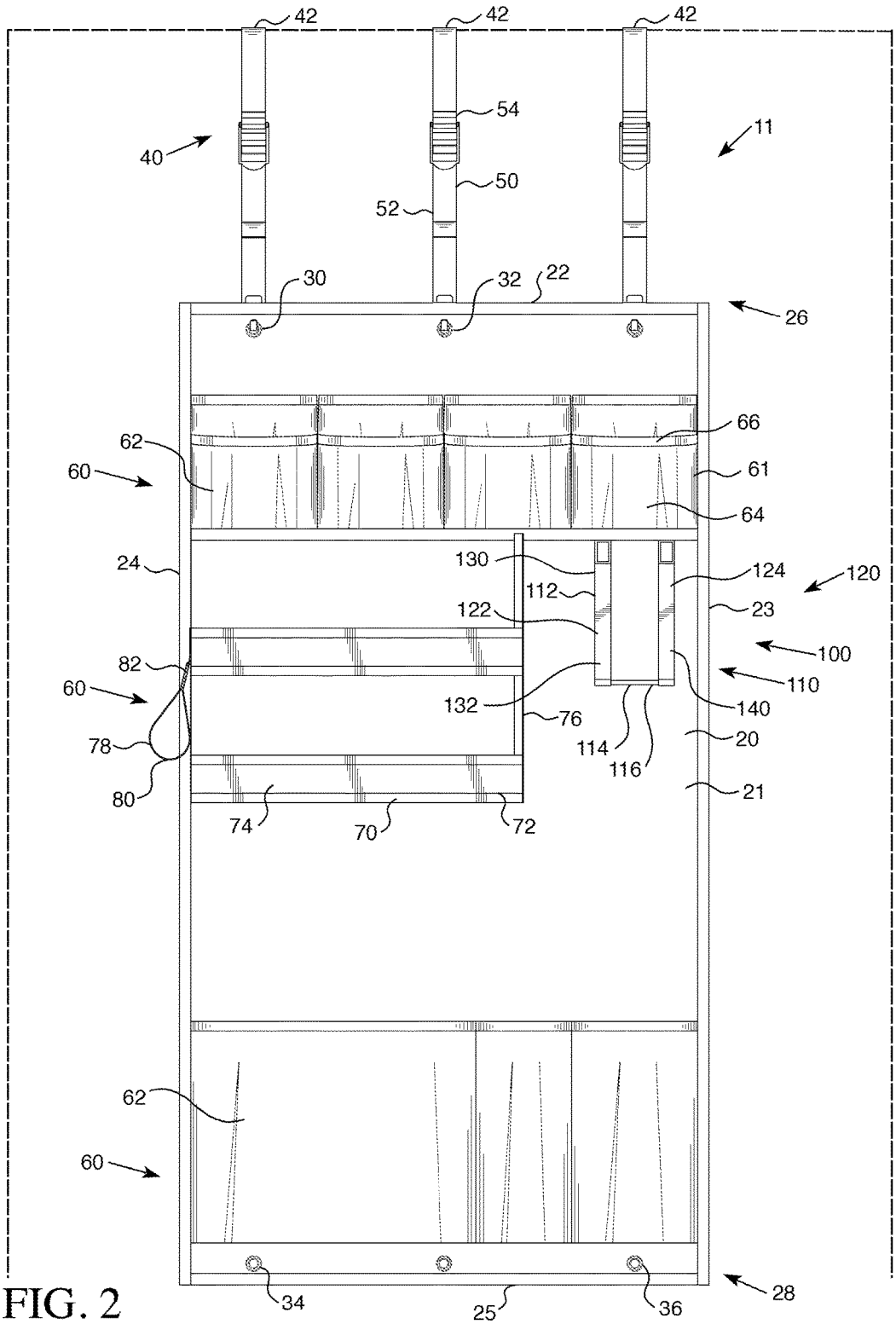
FIG. 2 is a front view of an organizer.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, and as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the elements defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve as a whole, moves relative to the body of the automobile.

As used herein, "depending" means to extend at an angle other than zero (0°) from another element without regard to direction. That is, for example, a "depending" sidewall may extend generally upwardly from a base. Further, a "depending" sidewall inherently has a distal end.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). Thus, for example, a "number of elements" means one element or a plurality of elements.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally curvilinear" includes elements having multiple curved portions, combinations of curved portions and planar portions, and a plurality of planar portions or segments disposed at angles relative to each other thereby forming a curve.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and/or near relevant to the term being modified as would be understood by one of ordinary skill in the art.

As used herein, a "vertical support" means a construct having a generally planar, generally vertical surface with a height greater than the height of the element that is supported by the "vertical support." For example, a "vertical support" for an organizer has a height that is greater than the height of the organizer.

As used herein, a "stapler" is a device including an elongated base, an elongated staple tray, and an actuator. The base and tray are pivotally coupled to each other at a proximal end and are structured to move between a first position, wherein the longitudinal axes of the base and tray are generally parallel and spaced from each other, and a second position, wherein the distal end of the tray is angled toward the distal end of the base. At the proximal end of the base and the tray, i.e., adjacent the pivot, one or both of the base and/or the tray includes an offset portion that extends toward the other element. The offset portion defines the pivotal coupling. Thus, in the first position, the offset portion defines, as used herein, a "perpendicular portion." Further, as used herein, staplers inherently have a "perpendicular portion." Also, under this definition, heavy duty devices, such as, but not limited to, staple guns, wherein the tray and base are unitary are not "staplers" in that the base and tray do not move between the first and second position defined above.

As used herein, to "suspend a stapler with minimal contact" means that the weight of the stapler is suspended at the "perpendicular portion" and from at least one tension member. That is, the force that counteracts the weight of the stapler acts through the "perpendicular portion." Thus, a stapler on a desk, i.e., wherein the base is resting on a planar surface, is not suspended with minimal contact. That is, a desk, table or other generally horizontal surface cannot "suspend a stapler with minimal contact." Further, a stapler that includes an additional coupling element, such as, but not limited to, a ring disposed at the proximal end, and wherein the stapler is suspended by the ring is not suspended with minimal contact. That is, any additional coupling element added to a stapler cannot "suspend a stapler with minimal contact." Further, a rigid cantilever member, such as, but not limited to, a peg board hook, is not capable of "suspend[ing] a stapler with minimal contact" because the peg board hook does not include a tension member.

As used herein, a "tension member" is a construct that has a maximum length when exposed to tension, but is otherwise substantially flexible, such as, but not limited to, a chain or a cloth strap.

As used herein, to "include an elastic portion" means that all, or some, or the identified element is able to stretch. That is, the term "elastic" is an adjective. For example, a band with a non-elastic canvas portion and an elastic rubber portion "include[s] an elastic portion." Further, a band made entirely from elastic (i.e., the noun "elastic") also "include[s] an elastic portion."

As used herein, to "maintain a stapler in an upright orientation" means that the longitudinal axis of a stapler extends substantially vertically.

As used herein, an "over-the-door bracket" is an element structured to support another element on one side of a door or similar construct. An "over-the-door bracket" inherently includes an inverted, generally U-shaped body having generally right angles between portions. That is, the U-shaped body inherently includes a generally horizontal portion, a hidden, first depending portion, and an exposed, second depending portion. The "hidden, first depending portion" is the portion disposed on the side of the door opposite the supported element. The "exposed, second depending portion" is the portion disposed on the side of the door as the supported element.

As used herein, an elongated element, such as, but not limited to a stapler, has an "upright orientation" when the longitudinal axis of the object is generally vertical.

As used herein, "hidden" means an element disposed on the side of a door opposite a supported element.

As shown in FIGS. 1-4, an organizer 10 is structured to be temporarily coupled to a vertical support 1 shown as, but is not limited to, a door 1 (hereinafter the vertical support 1 will be identified as a "door 1"). When the organizer 10 includes a hanging assembly 40 structured to be coupled to a door 1, the organizer 10 is, as used herein, an "over-the-door organizer" 11. The following discussion discusses an over-the-door organizer 11, but it is understood that, with the exception of the hanging assembly 40 structured to be coupled to a door, the discussion is also applicable to an organizer 10 that is structured to be temporarily coupled to a vertical support. The over-the-door organizer 11 is further structured to support, hold, enclose, and/or maintain other objects in an identified location.

The over-the-door organizer 11 includes a generally planar back member 20, a hanging assembly 40, and a retention assembly 60. In an exemplary embodiment, the back member 20 is made from a generally flexible material such as, but not limited to, canvas. That is, the back member 20 in an exemplary embodiment, is structured to move between a collapsed, first configuration, wherein the back member 20 occupies a smaller cross-sectional area, and, a generally flat, second configuration. For example, the back member 20 is, in an exemplary embodiment, rolled-up or folded so as to be transported; such a configuration is the first configuration. When the over-the-door organizer 11 is in use, the back member 20 is in the second configuration.

The back member 20 includes a body 21 that, in an exemplary embodiment, is generally rectangular and includes an upper side 22, a right, first lateral side 23, a left, second lateral side 24, and a lower side 25. The area at, i.e., near, the back member body upper side 22 is the upper end 26. The area at, i.e., near, the back member body lower side 25 is the lower end 28. The back member body upper end 26 includes a number of coupling components 30 which, in an exemplary embodiment, are passages 32 through the back member body 21. Similarly, the back member body lower end 28 includes a number of coupling components 30 which, in an exemplary embodiment, are passages 34 through the back member body 21. The back member body lower end passages 34 are structured to allow a second back member (not shown) to be coupled to the back member 20. As such, each back member body lower end passage 34 is an "extension coupling" 36 and solve the problem noted above. As used herein, an "extension coupling" means a coupling structured to allow a number of additional back member bodies 21 (shown in ghost in FIG. 1) to be coupled to the first back member body 21. As shown, the extension couplings 36 are opening through which a further coupling component (not shown) such as, but not limited to, a hook extend. In alternate embodiments, the extension couplings 36 are snap sockets and snap plugs, a zipper assembly, or buttonholes and buttons (none shown). In an alternate embodiment, not shown, the extension couplings 36 are disposed on the back member lateral sides 23, 24. The extension couplings 36 solve the problem(s) stated above.

Figure 3:
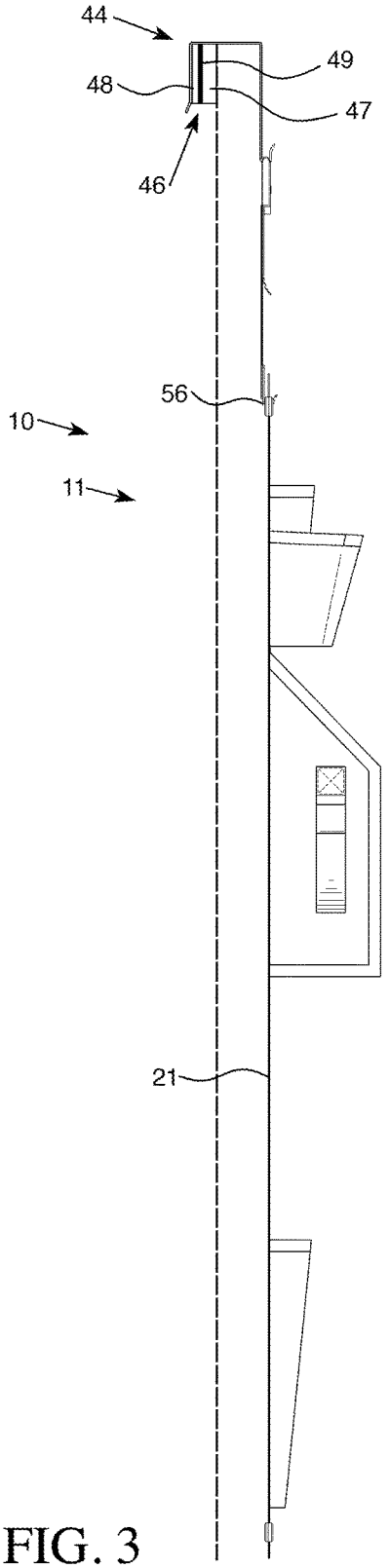
FIG. 3 is a first side view of an organizer.
Figure 4:
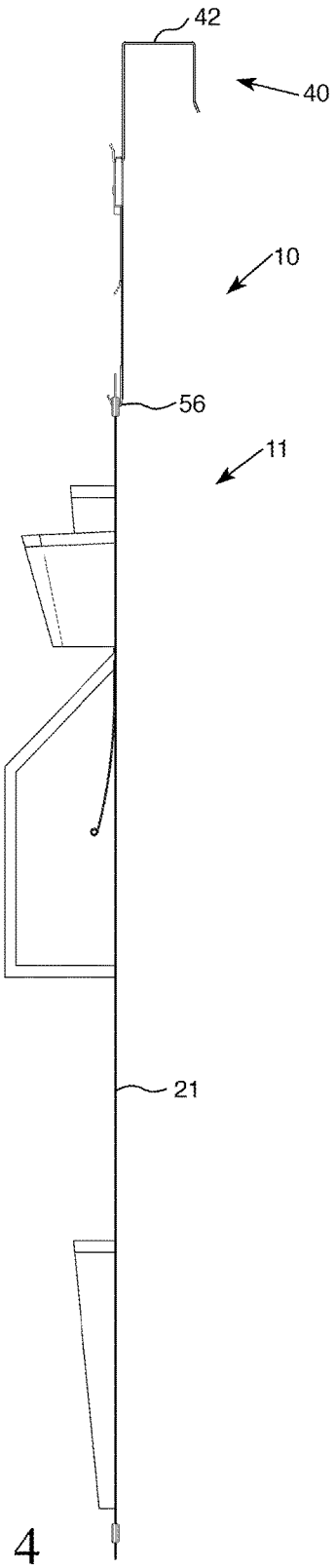
FIG. 4 is a second side view of an organizer.
Figure 5:
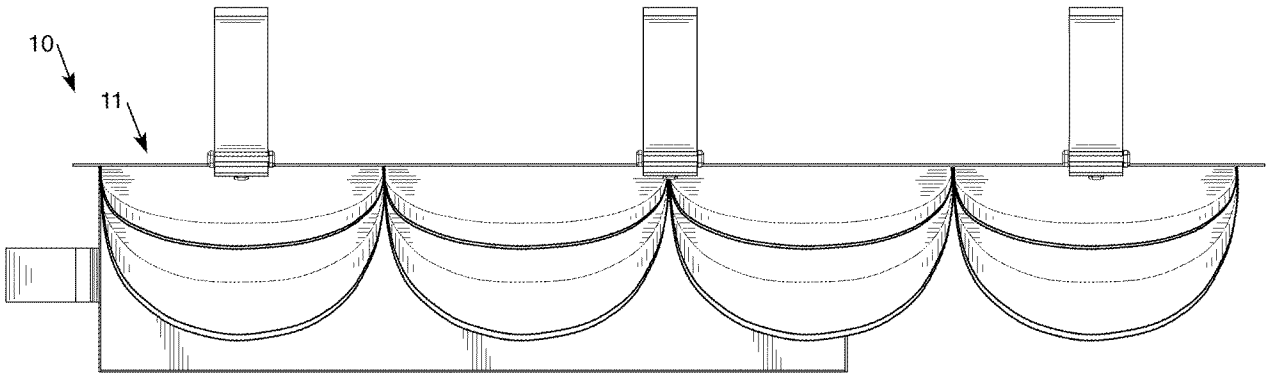
FIG. 5 is a top view of an organizer.
Figure 6:
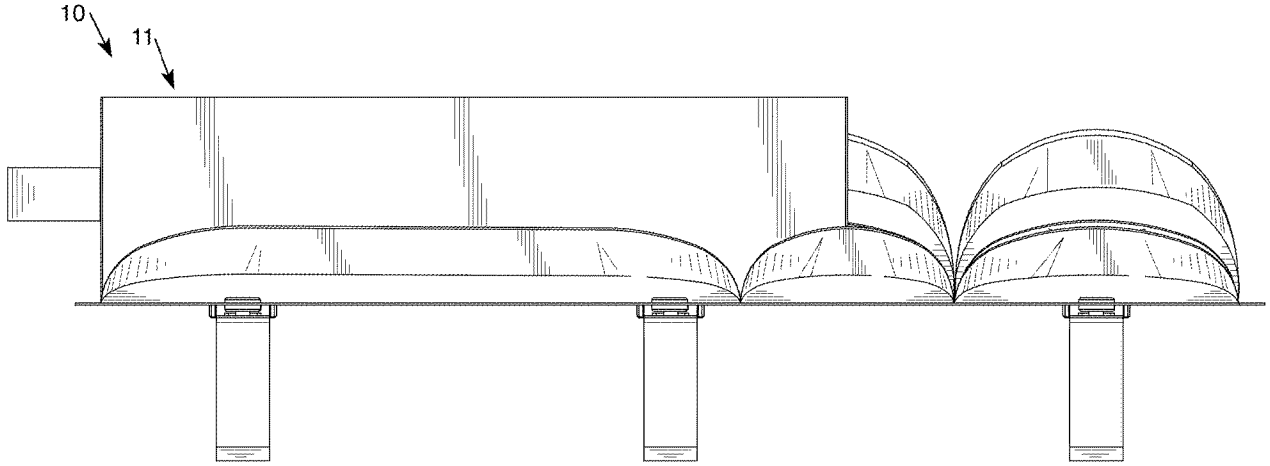
FIG. 6 is a bottom view of an organizer.
Figure 7:
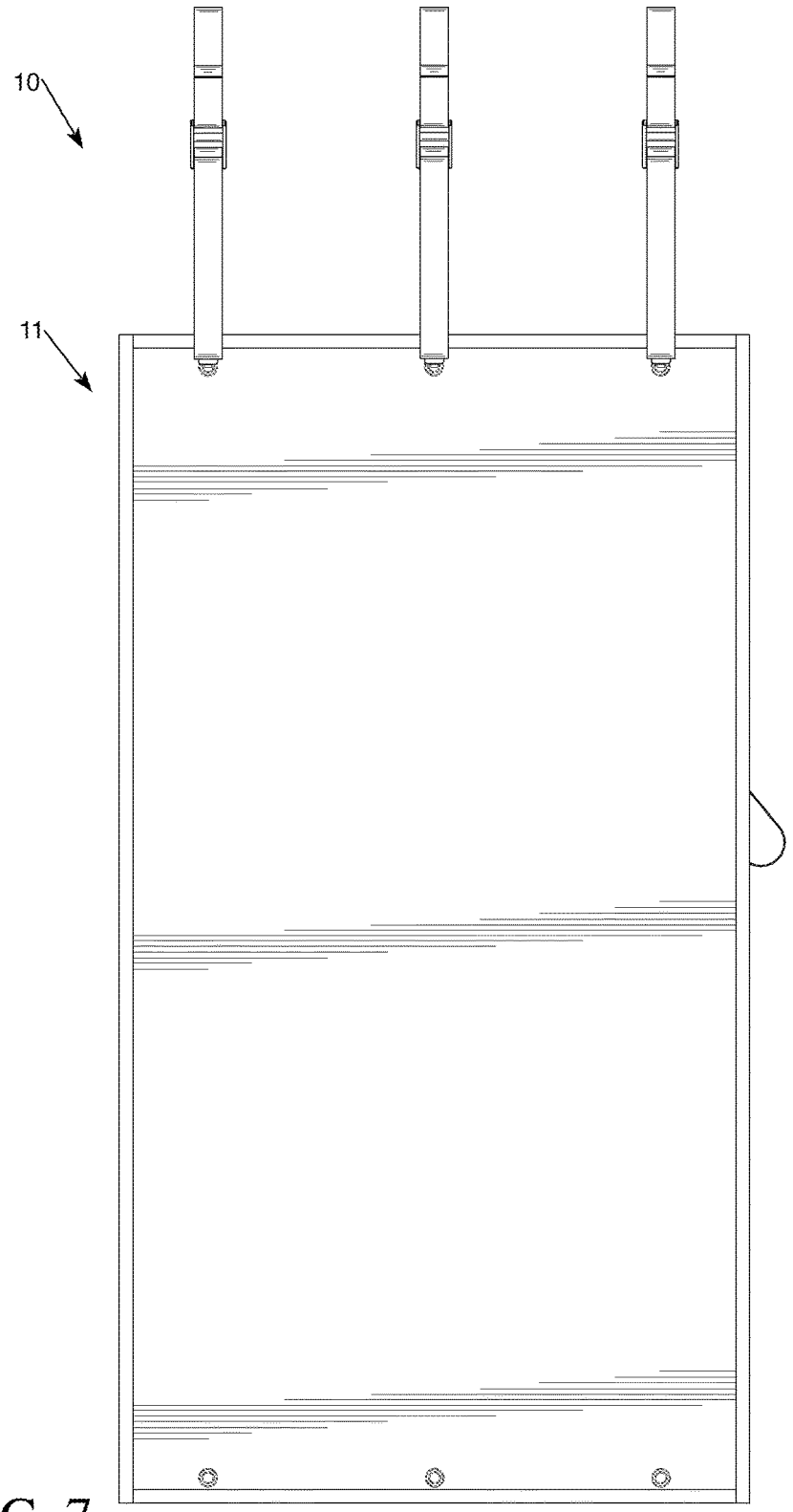
FIG. 7 is a back view of an organizer.

The hanging assembly 40 is structured to support the back member 20 from, or immediately adjacent to, a vertical support such as, but not limited to a door 1 or a wall (not numbered). That is, the hanging assembly 40 is coupled to the back member 20 and is structured to be further coupled to a vertical support. In an exemplary embodiment, the hanging assembly 40 includes a number of over-the-door brackets 42 and a number of orienting pad assemblies 44 (FIG. 3). Each orienting pad assembly 44 is associated with an over-the-door bracket 42. That is, in an exemplary embodiment, there is one orienting pad assembly 44 associated with each over-the-door bracket 42. Further, in an exemplary embodiment, each orienting pad assembly 44 is "hidden." That is, each orienting pad assembly 44 is coupled, directly coupled, or fixed to the "hidden first depending portion" of an over-the-door bracket 42. Further, in an exemplary embodiment, each orienting pad assembly 44 includes a resilient body 46, such as, but not limited to, a foam body. Further, orienting pad assembly body 46 includes a plurality of layers 47, 48 (two shown). The orienting pad assembly body layers 47, 48 are temporarily coupled to each other by an adhesive. That is, each orienting pad assembly body 46 plurality of layers 47, 48 includes a number of adhesive layers 49 (one shown). In this configuration, the orienting pad assembly body 46 is structured to have an alterable thickness. It is understood that the adhesive layers 49 between layers 47, 48 is relatively weak. As used herein a "weak" adhesive means that the bodies coupled by the adhesive can be decoupled without damaging the material forming the bodies.

It is understood that an orienting pad assembly body 46 is coupled to the inner surface of an over-the-door bracket 42. Because the orienting pad assembly body 46 is structured to have an alterable thickness, a user can alter the space between the orienting pad assembly body 46 and the second depending portion. For example, if a door 1 is relatively thick, i.e., the door 1 has a thickness about the same as the spacing between the hidden, first depending portion and the exposed, second depending portion of the over-the-door bracket 42, the user would not install, or would remove, the orienting pad assembly body 46 from the over-the-door bracket 42. If the door 1 was relatively thin, the user would install/use all layers 47, 48 of the orienting pad assembly body 46 so that the spacing between the orienting pad assembly body 46 and the second depending portion generally corresponds to the thickness of the door 1. If the door 1 was moderately thick, the user would remove/use a limited number of layers 47, 48, i.e., less than all layers 47, 48 of the orienting pad assembly body 46 so that the spacing between the orienting pad assembly body 46 and the second depending portion generally corresponds to the thickness of the door 1. In an exemplary embodiment, each orienting pad assembly body 46 plurality of layers 47, 48 includes at least one thick layer 47 and at least one thin layer 48. Thus, the hanging assembly 40 is structured to support the back member 20 from a vertical support wherein the vertical support has an unknown thickness without applying bias to the vertical support. This solves the problem(s) stated above.

Further, in an exemplary embodiment, the hanging assembly 40 includes a number of adjustable straps 50. Each adjustable strap 50 includes a body 52 with a first end 54 and a second end 56. Each strap body first end 54 is structured to be coupled to an over-the-door bracket 42. Each strap body second end 56 is structured to be coupled to the back member 20. Thus, for example, when the back member body lower end 28 includes a number of passages 34, each strap body second end 56 includes a hook sized to pass through an associated back member body lower end passage 34.

The retention assembly 60 includes a number of retention elements 61. Each retention element 61 is structured to retain a number of use objects on and/or adjacent to the back member 20. For this discussion, the use objects are, for example, as office items, e.g., paper clips, pads of paper, pens, pencils, scissors, (none shown), a stapler 2 and tape dispenser 4. The retention elements 61 maintain the use objects on and/or adjacent to the back member 20. For example, the retention assembly 60 includes a number of pockets 62. Each pocket 62, as shown, includes a generally rectangular member 64. As is known, three sides (two lateral and the bottom side) are coupled, directly coupled, or fixed to the back member 20 thereby defining an enclosed space that can be accessed via a top side 66 of the rectangular member 64. In an exemplary embodiment, the rectangular member top side 66 is elastic. Further, in an exemplary embodiment, the rectangular member 64 includes a number of folds or pleats so that the pocket 62 is structured to be, and is, expandable. The pockets 62 can be nested, i.e., one pocket 62 partially disposed within another pocket 62, as shown at back member body upper side 22, and/or have different sizes, as shown at back member body lower side 25.

The retention assembly 60, as shown, also includes a number of shelves 70. Each shelf 70 includes a generally planar base member 72 that is coupled to the back member 20 and extends generally perpendicular to the plane of the back member 20. As shown, each shelf 70 includes a lip 74 and sides 76 that extend generally perpendicular to the plane of the base member 72. Further, the retention assembly 60, as shown, also includes a loop 78 of material. The loop 78, in an exemplary embodiment, is a strap body 80 including a hook-and-loop coupling 82 so that the strap body 80 is structured to be coupled to itself thereby forming the loop 78. As shown, such a loop 78 is structured to support an object such as, but not limited to, a tape dispenser 4, as shown.

In an exemplary embodiment, the number of retention elements 61 includes a suspended stapler holder 100. The suspended stapler holder 100 is structured to, and does, suspend a stapler 2 with minimal contact. The stapler holder 100 includes a suspension assembly 110. The suspension assembly 110 is structured to, and does, support, i.e., hold up, a support element 112. The support element 112 is structured to, and does, contact a stapler 2 and/or a stapler perpendicular portion 3. In an exemplary embodiment, the support element 112 is an elongated cross member 114. An elongated cross member 114 includes a rigid body 116. The suspension assembly 110 is coupled, directly coupled, or fixed to the back member 20. In an exemplary embodiment, the suspension assembly 110 includes a number of elongated suspension elements 120. In the embodiment shown, there are two suspension elements 120, each of which are a tension member.

That is, in an exemplary embodiment, the suspension assembly 110 includes a number of bands 122, 124 (two shown) wherein each band has a first end 130 and a second end 132. As shown, each band first end 130 is coupled, directly coupled, or fixed to the back member 20 and each band second end 132 is coupled, directly coupled, or fixed to the support element 112, i.e., cross member 114. That is, cross member 114 extends between, and is coupled to both, the first band second end 132 and the second band second end 132.

In one embodiment, each band 122, 124 is substantially non-elastic. For example, each band 122, 124 is made of a flexible but non-elastic material such as, but not limited to, canvas. Further, in another exemplary embodiment, each band 122, 124 includes an elastic portion 140. In this configuration, the suspension assembly 110 is structured to, and does, move between a suspended, first position, wherein each elastic portion 140 is not substantially stretched, and a use, second position, wherein each elastic portion 140 is substantially stretched. In this configuration, the suspended stapler holder 100, i.e., the suspension assembly 110, is structured to maintain a stapler 2 in an upright orientation when the suspension assembly 110 is in the first position. A suspended stapler holder 100 in this configuration solves the problem(s) stated above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An organizer comprising:

a generally planar back member;

a hanging assembly coupled to said back member and structured to be further coupled to a vertical support;

a retention assembly including a number of retention elements;

each retention element structured to maintain an object adjacent to said back member;

said number of retention elements including a suspended stapler holder, said suspended stapler holder structured to suspend a stapler with minimal contact;

wherein said suspended stapler holder includes a suspension assembly;

said suspension assembly coupled to said back member;

said suspension assembly including a number of elongated suspension elements;

wherein each said suspension element is a tension member;

wherein said suspended stapler holder includes a rigid support element;

said rigid support element structured to contact a stapler perpendicular portion;

wherein said suspension assembly includes a number of bands;

each said band including a first end and a second end;

each said band first end coupled to said back member;

each said band second end coupled to said rigid support element;

wherein each band includes an elastic portion;

wherein said suspension assembly is structured to move between a suspended, first position, wherein each elastic portion is not substantially stretched, and a use, second position, wherein each elastic portion is substantially stretched; and wherein said suspension assembly is structured to maintain a stapler in an upright orientation when said suspension assembly is in said first position.

2. An organizer comprising:

a generally planar back member;

a hanging assembly coupled to said back member and structured to be further coupled to a vertical support;

a retention assembly including a number of retention elements;

each retention element structured to maintain an object adjacent to said back member;

said number of retention elements including a suspended stapler holder, said suspended stapler holder structured to suspend a stapler with minimal contact;

wherein said suspended stapler holder includes a suspension assembly;

said suspension assembly coupled to said back member;

said suspension assembly including a number of elongated suspension elements;

wherein each said suspension element is a tension member;

wherein said suspended stapler holder includes a rigid support element;

said rigid support element structured to contact a stapler perpendicular portion;

wherein said suspension assembly includes a number of bands;

each said band including a first end and a second end;

each said band first end coupled to said back member;

each said band second end coupled to said rigid support element;

said number of bands includes an elongated first band and an elongated second band;

said rigid support element includes an elongated cross member;

said cross member extending between, and coupled to both, said first band second end and said second band second end;

each band includes an elastic portion;

wherein said suspension assembly is structured to move between a suspended, first position, wherein said first band elastic portion and said second band elastic portion are not substantially stretched, and a use, second position, wherein said first band elastic portion and said second band elastic portion are substantially stretched; and wherein said suspension assembly is structured to maintain a stapler in an upright orientation when said suspension assembly is in said first position.

* * * * *